US011122894B1

(12) United States Patent
Kanipe

(10) Patent No.: US 11,122,894 B1
(45) Date of Patent: Sep. 21, 2021

(54) SYSTEMS, METHODS, AND APPARATUSES FOR LOAD BEARING SLIDES

(71) Applicant: TPA Motion, LLC, Fort Mill, SC (US)

(72) Inventor: Eric Todd Kanipe, Fort Mill, SC (US)

(73) Assignee: TPA MOTION, LLC, Fort Mill, SC (US)

( * ) Notice: Subject to any disclaimer, the term of this patent is extended or adjusted under 35 U.S.C. 154(b) by 0 days.

(21) Appl. No.: 16/804,464

(22) Filed: Feb. 28, 2020

(51) Int. Cl.
*A47B 88/00* (2017.01)
*A47B 88/493* (2017.01)
*A47B 88/443* (2017.01)

(52) U.S. Cl.
CPC ..... *A47B 88/493* (2017.01); *A47B 88/443* (2017.01); *A47B 2210/007* (2013.01); *A47B 2210/0029* (2013.01); *A47B 2210/0059* (2013.01)

(58) Field of Classification Search
CPC ..... A47B 88/443; A47B 88/493; A47B 2210/0029; A47B 2210/0054; A47B 2210/0059; A47B 2210/007
See application file for complete search history.

(56) References Cited

U.S. PATENT DOCUMENTS 4,482,066 A * 11/1984 Dykstra ..... A47B 88/493 211/151
5,484,197 A * 1/1996 Hansen ..... A47B 88/42 312/334.12
5,556,182 A * 9/1996 Lai ..... A47B 88/487 312/334.19
7,458,651 B1 * 12/2008 Radke ..... A47B 88/467 312/333
7,971,944 B2 * 7/2011 Sagel ..... A47B 88/42 312/334.25
8,851,587 B2 * 10/2014 Brock ..... F16C 29/045 312/334.39
2012/0049713 A1 * 3/2012 Tingle ..... A47B 88/42 312/334.33
2013/0077900 A1 * 3/2013 Lowe ..... A47B 88/49 384/18
2014/0062280 A1 * 3/2014 Braun ..... A47B 96/00 312/326

* cited by examiner

*Primary Examiner* — Matthew W Ing
(74) *Attorney, Agent, or Firm* — Alston & Bird LLP

(57) ABSTRACT

Slides provided herein may be configured to support substantial loads while experiencing vibration and shock in the retracted position without degradation of the slide mechanism. An example slide may include: a fixed rail member; a second rail member, a third rail member, where the second rail member is disposed between the fixed rail member and the third rail member, where the second and third rail members translate between an extended position relative to the fixed rail member and a retracted position relative to the fixed rail member; and at least one bearing attached to one of the second rail member or the third rail member, where the at least one bearing is engaged when the second rail member is in the extended position, and disengaged in response to the third rail member being in the retracted position.

20 Claims, 11 Drawing Sheets

SYSTEMS, METHODS, AND APPARATUSES FOR LOAD BEARING SLIDES

TECHNOLOGICAL FIELD

Embodiments of the present invention relate generally to slides to support weight as they translate between a retracted and an extended position, and more particularly, to systems, methods, and apparatuses for slides configured to support substantial loads while experiencing vibration and shock forces in the retracted position without degradation of the slide mechanism.

BACKGROUND

Slides are conventionally used for drawers in cabinetry, tool boxes, and the like to enable movement of a drawer or payload between a retracted position in which the contents of the drawer are generally inaccessible, and an extended position in which the contents of the drawer are generally accessible. Slides which may sometimes be generally referred to as drawer slides may be used in a variety of applications in which lateral translation is needed from a first position to a second position. While the general term "drawer slides" may be common, such slides may have applications beyond a conventional drawer. For example, slides may be used to move a payload from a first position to a second position, where the payload may include any type of object. Slides may be used in vehicles, such as a recreational vehicle, for moving a generator from an enclosed bay to an accessible position outside of the vehicle for service. Slides come in a variety of types, sizes, and weight capacities and include various types of mechanisms to facilitate the sliding operation. Sliding of light-duty slides may be accomplished through surface-to-surface contact, and may be improved through the use of low friction materials to aid the sliding operation. Higher capacity slides may use ball bearings or rollers to support the load and allow translation of the drawer slide between the extended and retracted positions.

BRIEF SUMMARY

Embodiments of the present invention relate generally to slides to support a payload as they translate between a retracted and an extended position. Slides of example embodiments may be configured to support substantial loads and weights while experiencing vibration and shock forces in the retracted position without degradation of the slide mechanism. An example embodiment of a slide provided herein includes a fixed rail member; a second rail member, where the second rail member translates between an extended position relative to the fixed rail member and a retracted position relative to the fixed rail member; a third rail member, where the second rail member is disposed between the fixed rail member and the third rail member, where the third rail member translates between an extended position relative to the fixed rail member and a retracted position relative to the fixed rail member; and at least one bearing attached to one of the second rail member or the third rail member, where the at least one bearing is engaged with both the second rail member and the third rail member when the second rail member is in the extended position, and where the at least one bearing is disengaged from at least one of the second rail member or the third rail member in response to the third rail member being in the retracted position.

According to an example embodiment, the fixed rail member includes a first lifting element, where the third rail member includes a second lifting element, where in response to the third rail member being moved to the retracted position, the first lifting element cooperates with the second lifting element to raise the third rail member relative to the fixed rail member, and in response to the third rail member being raised, the third rail member raises the second rail member disengaging the at least one bearing from at least one of the second rail member and the third rail member. The first lifting element of an example embodiment includes at least one of a pin, a wedge element, a conical element, a frustoconical element, a pyramidal element, a frusto-pyramidal element, and a recess, wherein the second lifting element includes at least one of a pin, a wedge element, a conical element, a frustoconical element, a pyramidal element, a frusto-pyramidal element, and a recess.

Embodiments may include at least one second bearing attached to one of the fixed rail member or the second rail member, where the at least one second bearing is engaged with both the fixed rail member and the second rail member in response to the third rail member being in the extended position, and where the at least one second bearing is disengaged from at least one of the fixed rail member and the second rail member in response to the second rail member being disposed in the retracted position. The third rail member may include a third lifting element, where in response to the third rail member being moved to the retracted position, the first lifting element cooperates with the third lifting element to raise the third rail member relative to the fixed rail member, thereby disengaging the at least one second bearing from at least one of the second rail member and the third rail member.

According to an example embodiment, the slide includes a fastener coupled to the third rail member, where the fastener secures the third rail member to the fixed rail member in response to the third rail member being in the retracted position and the fastener being engaged with the fixed rail member. Engagement of the fastener with the fixed rail member may drive the third rail member into the retracted position. Embodiments may include a front member attached to the second rail member and a fastener extending through the front member, where the fastener is configured to engage the fixed rail member and secure the third rail member to the fixed rail member in the retracted position.

Embodiments provided herein may include a slide having: a fixed rail member including a first lifting element; a second rail member including a second lifting element, where the second rail member translates between an extended position relative to the fixed rail member and a retracted position relative to the fixed rail member; and an intermediate rail member disposed between the fixed rail member and the second rail member, where the intermediate rail member translates between an extended position relative to the fixed rail member and a retracted position relative to the fixed rail member, where in response to the second rail member translating to the retracted position, the first lifting element cooperates with the second lifting element to raise the intermediate rail member relative to the fixed rail member.

According to an example embodiment, the second rail member supports a payload, the slide may include at least one bearing disposed between the intermediate rail member and the second rail member, where in response to the second rail member being in the extended position relative to the fixed rail member, the at least one bearing bears at least a portion of the weight of the payload. In response to the second rail member being in the retracted position, the at least one bearing does not bear at least a portion of the weight of the payload. The second rail member may support a payload, and the slide may include at least one first bearing disposed between the fixed rail member and the intermediate rail member, and at least one second bearing disposed between the intermediate rail member and the second rail member. In response to the intermediate rail member being in the extended position relative to the fixed rail member, the at least one first bearing bears at least a portion of a weight of the payload, and in response to the second rail member being in the extended position relative to the fixed rail member, the at least one second bearing bears at least a portion of the weight of the payload.

According to an example embodiment, in response to the intermediate rail member being in the retracted position and the second rail member being in the retracted position, the at least one first bearing does not bear at least a portion of the weight of the payload and the at least one second bearing does not bear at least a portion of the weight of the payload. Embodiments may include a fastener coupled to the second rail member, where the fastener secures the second rail member to the first rail member in response to the second rail member being in the retracted position and the fastener being engaged with the fixed rail member. Engagement of the fastener with the fixed rail member may drive the second rail member into the retracted position. Embodiments may include a front member attached to the second rail member and a fastener extending through the front member, where the fastener is configured to engage the fixed rail member and secure the second rail member to the fixed rail member in the retracted position.

Embodiments provided herein disclose a method including: supporting a payload on a second rail member in response to the second rail member being in an extended position relative to a fixed rail member and an intermediate rail member between the fixed rail member and the second rail member, where the payload weight is transferred from the second rail member through the intermediate rail member to the fixed rail member through at least one bearing; and lifting the intermediate rail member relative to the fixed rail member in response to the second rail member being moved to a retracted position, where the payload weight ceases to be transferred from the second rail member to the intermediate rail member and the fixed rail member through the at least one bearing.

The lifting of the intermediate rail member relative to the fixed rail member is performed in response to a first lifting element of the fixed rail member engaging a second lifting element of the second rail member in response to the second rail member being secured in the retracted position. The first lifting element may include at least one of a pin, a wedge element, a conical element, a frustoconical element, a pyramidal element, a frusto-pyramidal element, and a recess, and where the second lifting element may be at least one of a pin, a wedge element, a conical element, a frustoconical element, a pyramidal element, a frusto-pyramidal element, and a recess. Lifting the intermediate rail member relative to the fixed rail in response to the second rail member being moved to the retracted position may include driving the second rail member to the retracted position with a fastener engaging the second rail member with the fixed rail member.

BRIEF DESCRIPTION OF THE DRAWINGS

Figure 1:
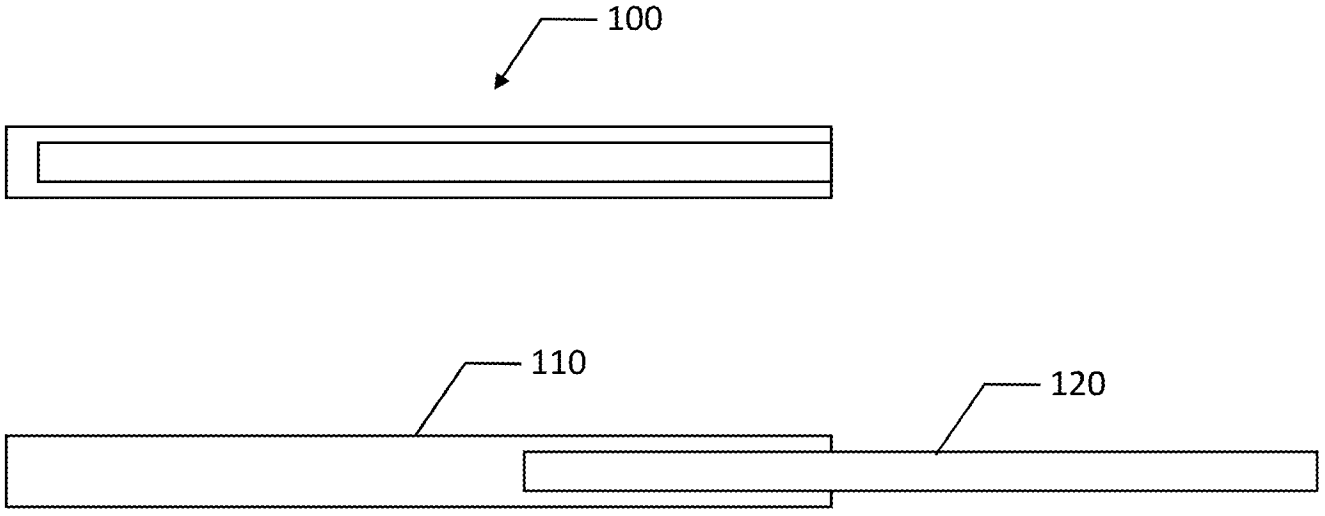
Figure 2:
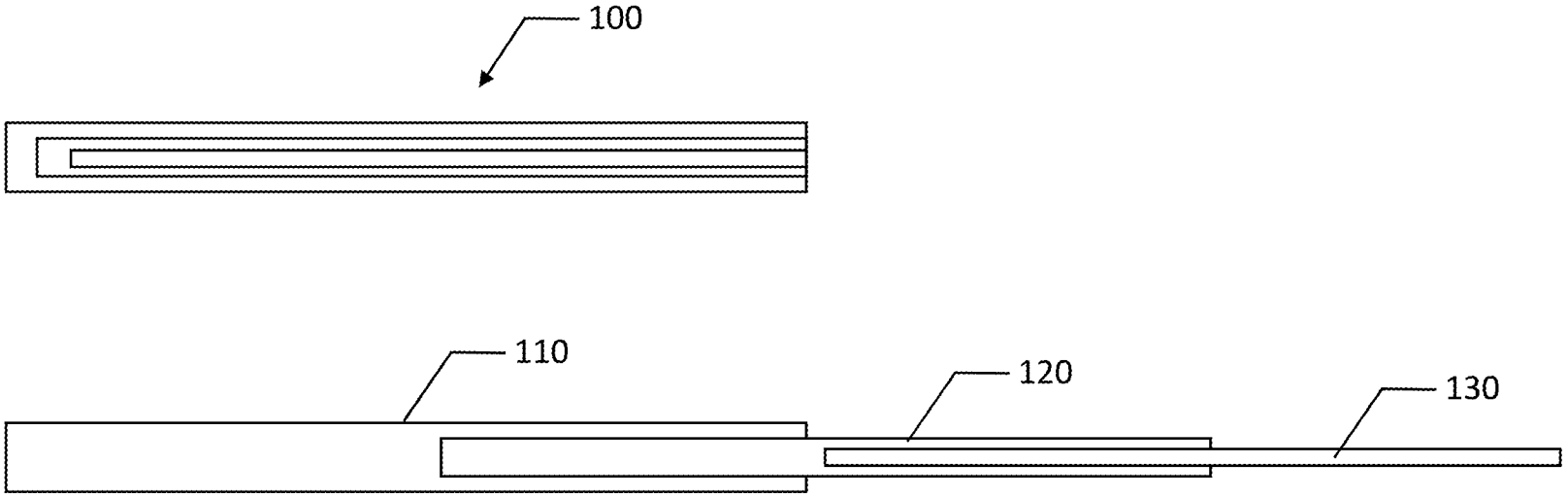
Figure 3:
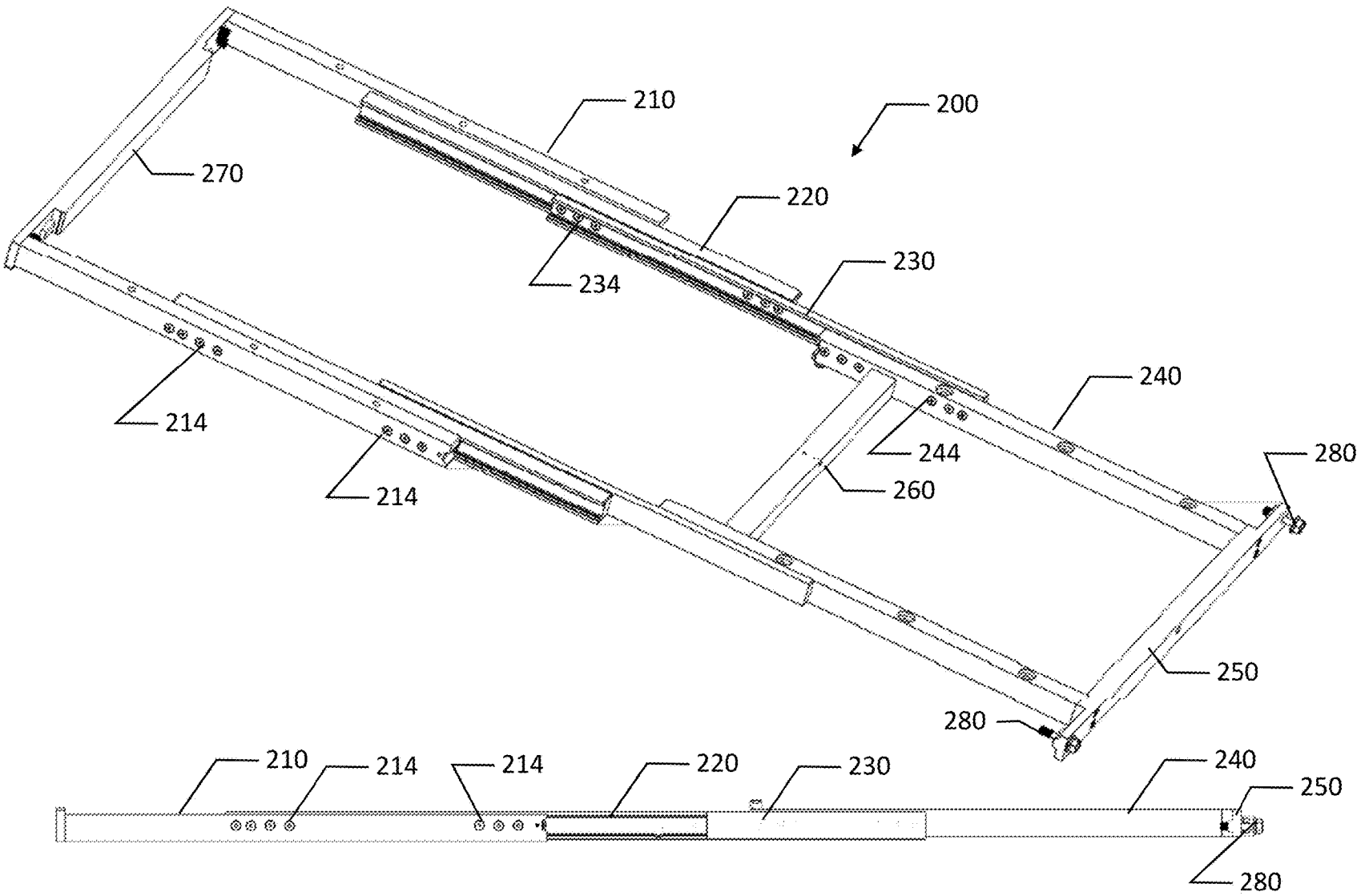
Figure 4:
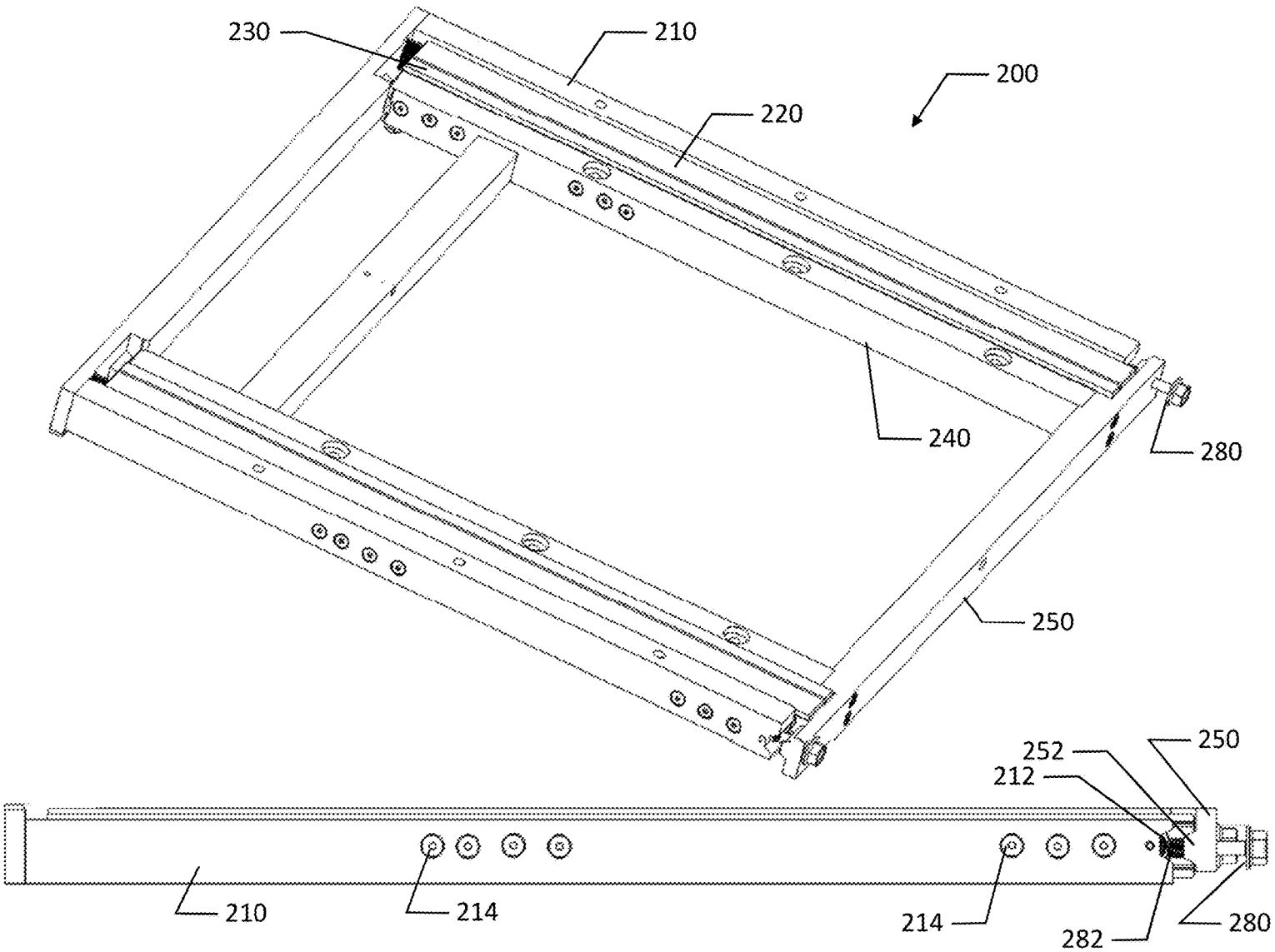
Figure 5:
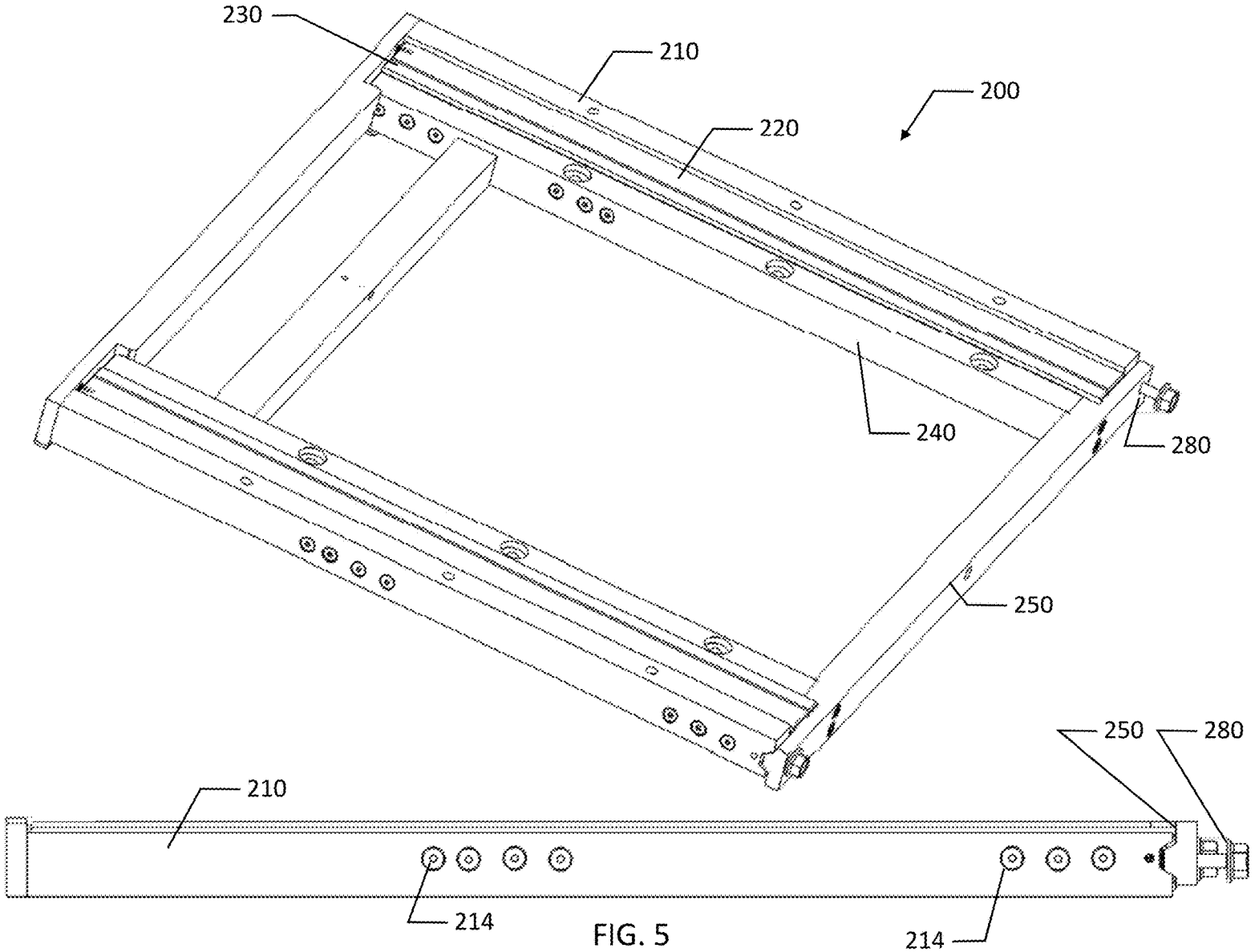
Figure 6:
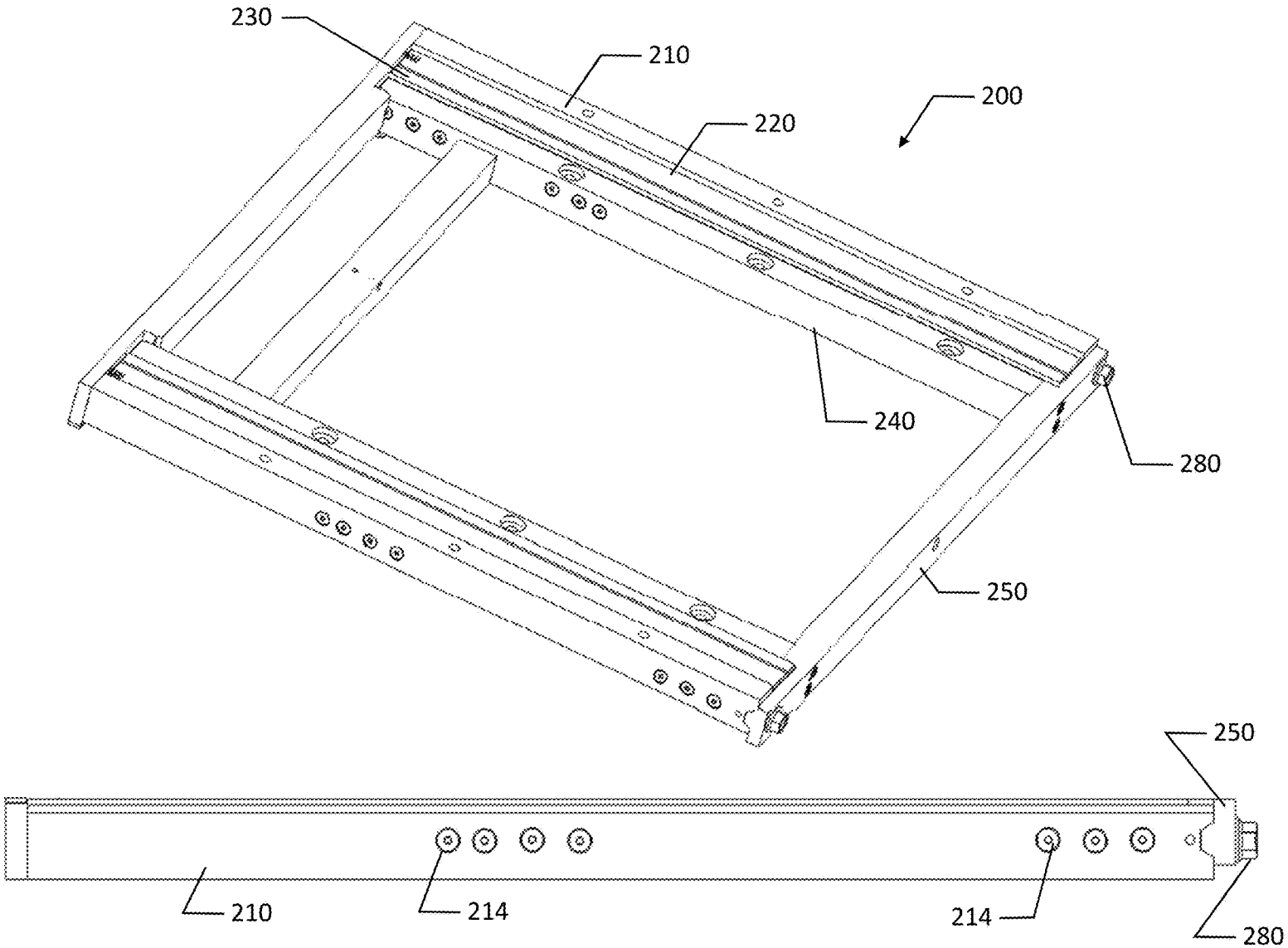
Figure 7:
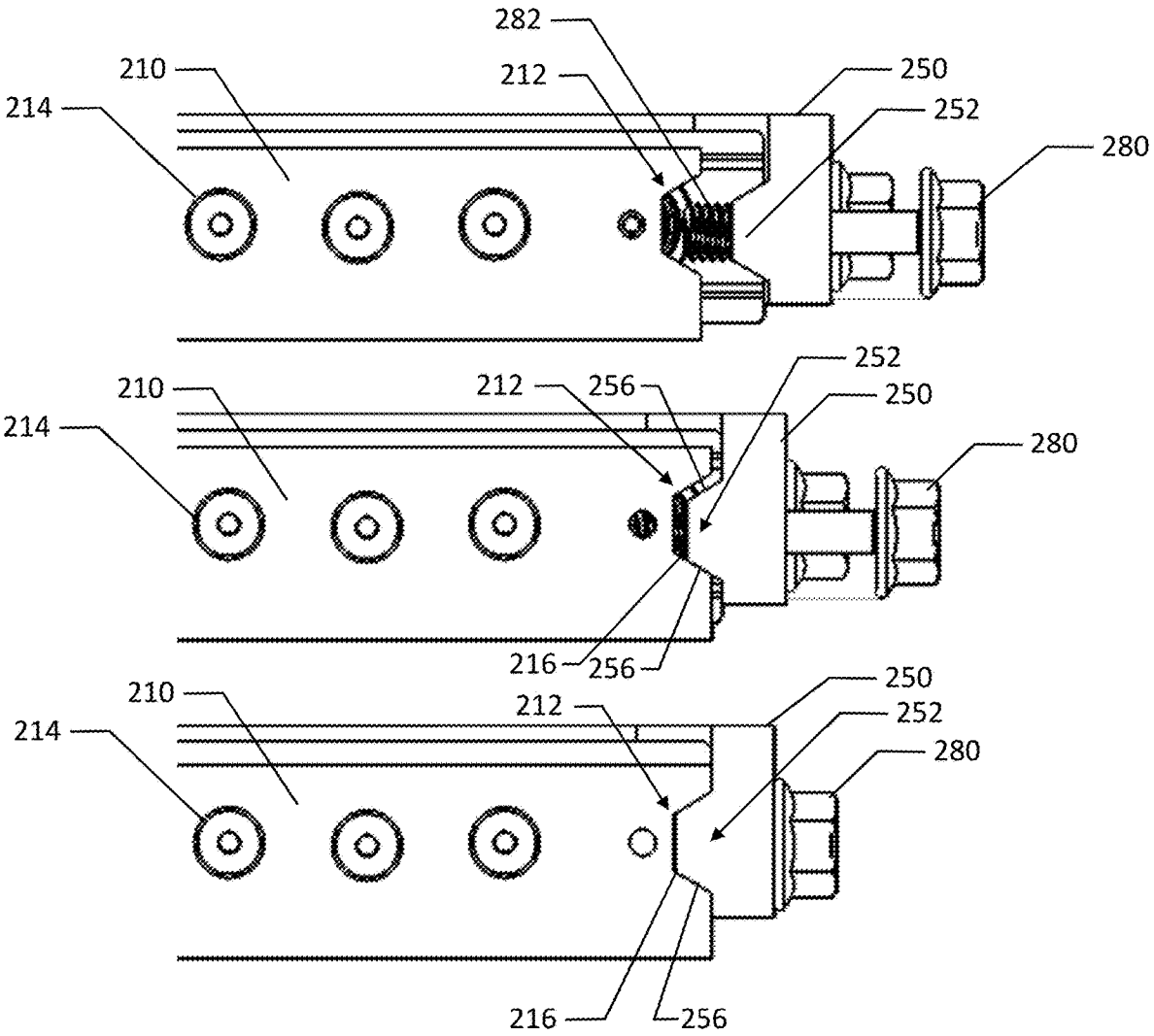
Figure 8:
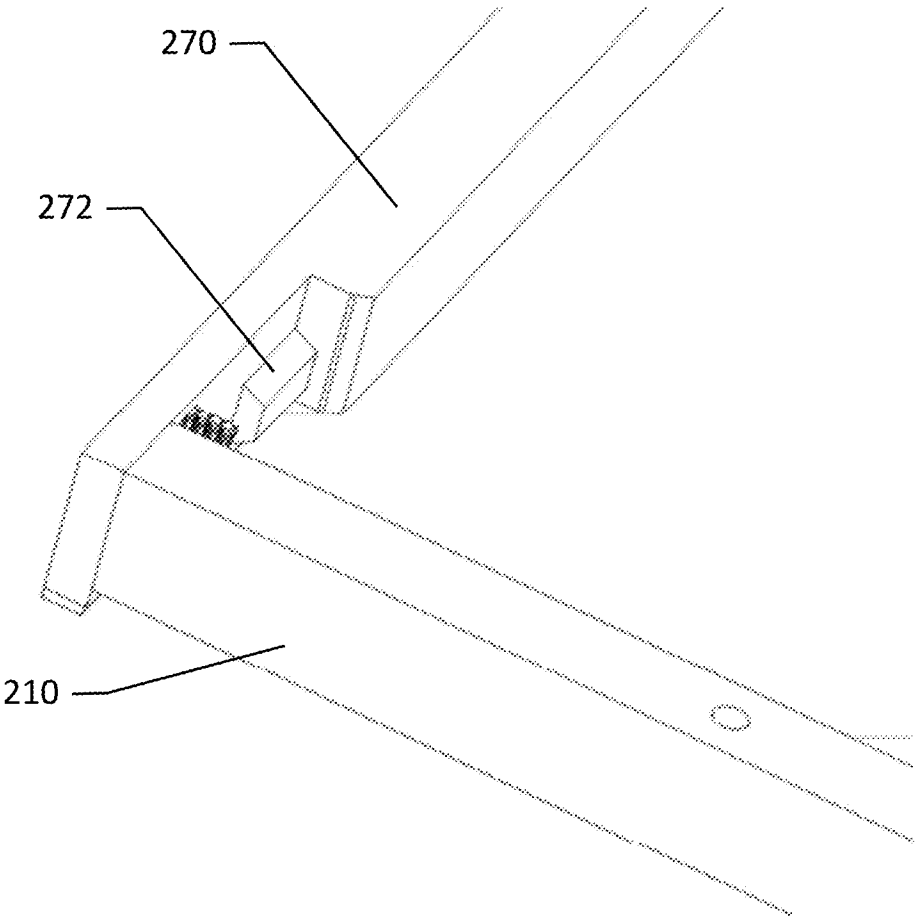
Figure 9:
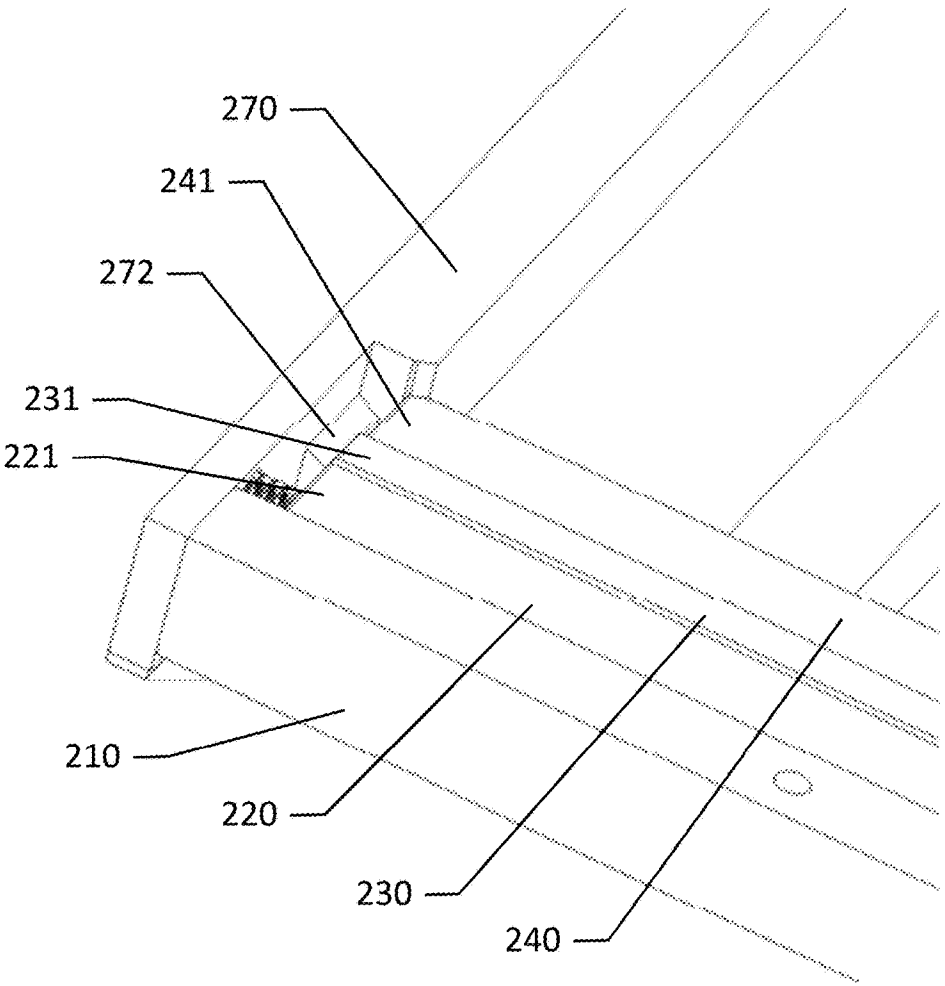
Figure 10:
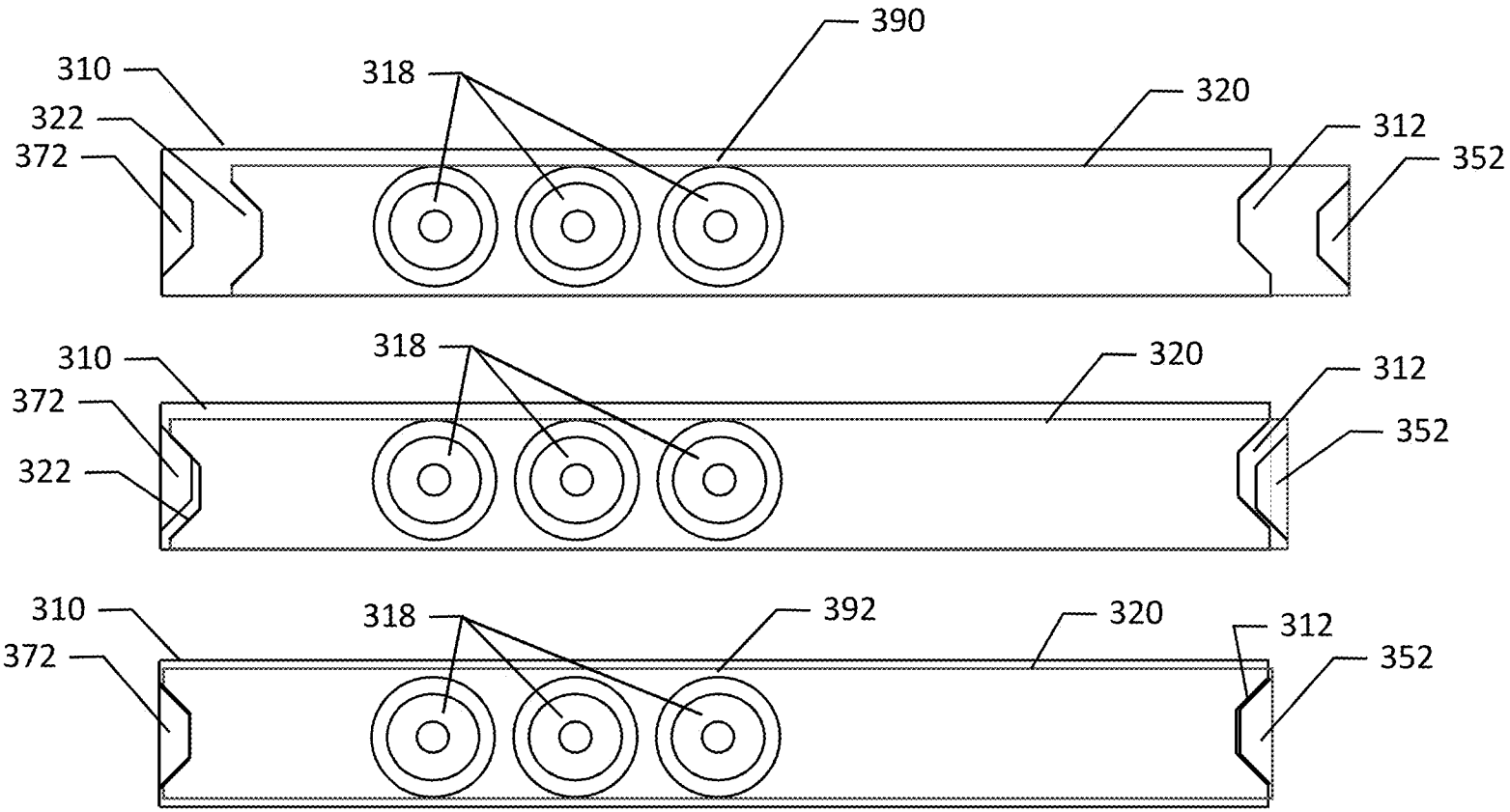
Figure 11:
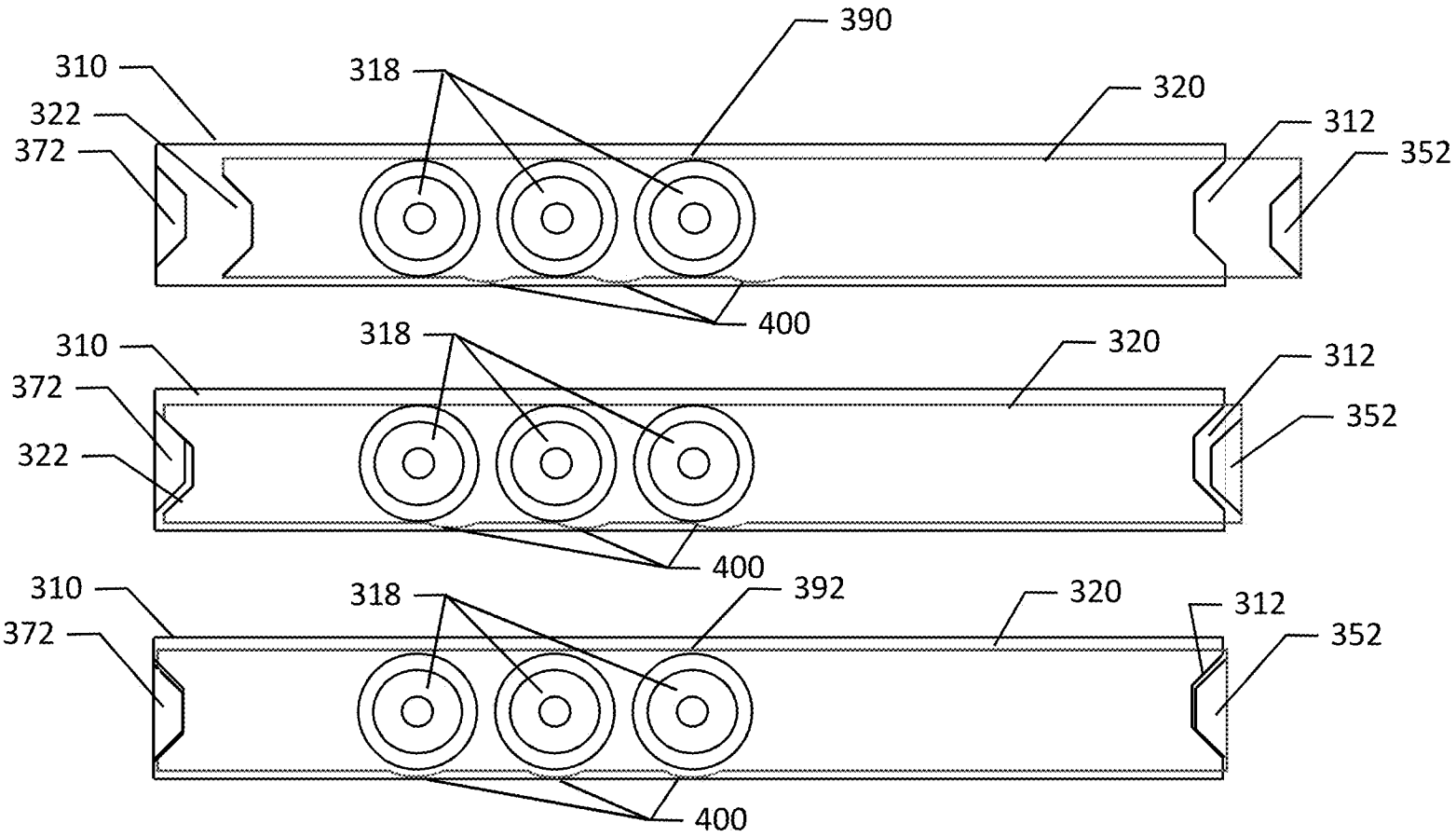

Having thus described embodiments of the invention in general terms, reference will now be made to the accompanying drawings, which are not necessarily drawn to scale, and wherein:

FIG. 1 illustrates a simplified example embodiment of a semi-telescopic slide according to an example embodiment of the present disclosure;

FIG. 2 illustrates a simplified example embodiment of a telescopic slide according to an example embodiment of the present disclosure;

FIG. 3 illustrates an example embodiment of the present disclosure as implemented in a four-piece telescoping slide in both a perspective view and a side view;

FIG. 4 illustrates the four-piece telescoping slide of FIG. 3 approaching the retracted, closed position in both a perspective view and a side view according to an example embodiment of the present disclosure;

FIG. 5 illustrates the four-piece telescoping slide of FIG. 3 in the pre-closed position in both a perspective view and a side view according to an example embodiment of the present disclosure;

FIG. 6 illustrates the four-piece telescoping slide of FIG. 3 in the closed position in both a perspective view and a side view according to an example embodiment of the present disclosure;

FIG. 7 depicts detail views of the recess and wedge elements of a telescoping slide according to an example embodiment of the present disclosure;

FIG. 8 depicts a wedge element of a rear member of a telescoping slide in an extended position according to an example embodiment of the present disclosure;

FIG. 9 depicts a wedge element of a rear member of a telescoping slide in a nearly closed position according to an example embodiment of the present disclosure;

FIG. 10 illustrates the unloading of bearings using slides according to an example embodiment of the present disclosure; and FIG. 11 illustrates the unloading of bearings using slides according to another example embodiment of the present disclosure.

DETAILED DESCRIPTION

Some examples of the present disclosure will now be described more fully hereinafter with reference to the accompanying drawings, in which some, but not all examples of the present disclosure are shown. Indeed, the present disclosure may be embodied in many different forms and should not be construed as limited to the examples set forth herein; rather, these examples are provided so that this disclosure will satisfy applicable legal requirements. Like numbers refer to like elements throughout.

Systems, methods, and apparatuses are herein provided for slides and the implementation thereof. Systems, methods, and apparatuses in accordance with various embodiments provide several advantages to conventional slides, particularly in a dynamic environments in which the payload carried by the slides may experience dynamic loading and vibration. In this regard, some example embodiments provide a system for supporting a payload as the slide(s) translate between a retracted and an extended position, and more particularly, to systems, methods, and apparatuses for slides configured to support substantial payloads while experiencing vibration and shock forces in the retracted position without degradation of the slide mechanism.

While embodiments described herein refer generally to "slides" and "drawer slides", embodiments may be used for any sliding extension mechanism that will benefit from example embodiments described herein. For example, slides may be used to translate a drawer, platform, or tray between a retracted and an extended position, or used to slide hardware such as a tool or device from a retracted, stowed position to an extended, accessible position. Further, as will be appreciated by one of ordinary skill in the art, slides may be used to elongate a surface, such as a table or workbench to extend the workable surface, and various other applications in which slides may be beneficial.

Slides are a mechanism used to support a payload as it translates between a retracted position and an extended position. One common example is a kitchen drawer that is supported by slides as it moves between a stowed, retracted position and an extended, accessible position. Slides can be of a variety of types and configurations, such as semi-telescopic, where the allowed movement is significantly less than the slide length, commonly 50%-75% of the slide length. FIG. 1 illustrates a simplified example embodiment of a semi-telescopic slide 100 in a retracted position and in an extended position where a fixed rail member 110 is held static, such as in a cabinet, while the moving rail member 120 slides to an extended position. This "2-piece" design has one fixed rail member 110 and one moving rail member 120. The two rail members conventionally have some friction-reducing mechanism therebetween, such as lubrication or low-friction surfaces in a light-duty slide used for lighter weight drawers, or bearings which may be used for light-duty drawers to provide smoother operation and may have substantially higher load capacity.

Slides may include full-extension slides, where the allowed movement is approximately the same as the slide length, commonly 80% to 120% of the length of the slide. Such slides are typically 3-piece designs, as shown in FIG. 2, with one fixed rail member 110, a moving rail member 120 as an intermediate member, and a third moving rail member 130. With 100% extension slides, the outermost rail or third rail member 130 in the illustrated embodiment, extends entirely away from the fixed rail member 110, as shown by the third rail member 130 not overlapping with the fixed rail member 110 in the extended position shown in FIG. 2. The moving rail member 120 as the intermediate rail member is used to bridge between the fixed rail member 110 and the third rail member 130. As shown, approximately half of the intermediate moving rail member 120 is engaged with the third rail member 130 and approximately half of the intermediate moving rail member is engaged with the fixed rail member 110 to support a payload attached to the third rail member.

Beyond the two and three-piece slides of FIGS. 1 and 2, slides can also be hyper-extension where the allowed movement is more than 125% of the length of the slide in the retracted, stowed position. Such slides may be a four-piece design with two intermediate rail members. Depending on load capacity and size, hyper extension slides may be substantially longer with more intermediate members as necessary for specific applications.

As noted above, lower-cost and lower load capacity slides may use a low friction material between two elements of a two-piece slide, or include one or more wheels to engage a rail. Higher capacity and generally more expensive slides may use caged ball bearings to smoothly translate the slide members relative to one another even with heavy loads. Such bearings are often used with tool box drawers and filing cabinet drawers that may experience heavy loading.

While most slide applications move relatively light payloads in and out of a cabinet, some applications are much harder on the bearing mechanisms. Such embodiments may be found in industrial, transportation, and military applications. In such embodiments, a telescopic slide and its payload may be subject to high vibration and/or impact loads. The vibration and/or impact loads may damage bearing elements causing the telescopic slide to fail. Failure modes may range from loss of smooth translation between the retracted position and the extended position to a loss of ability to translate the slide and payload from the retracted position to the extended position.

Embodiments described herein provide a slide that eliminates the risk of vibration and impact loads from damaging the telescopic slide bearings while the slide is in the closed, retracted position through a lock-up mechanism. While the telescopic slide is extended, the operation and bearing implementation is as typical within slides described above. However, as the telescopic slide is translated to the retracted position, during the last few percent of travel before being fully retracted, the bearing raceways of the moving rail member(s) are raised to remove any substantial load from the bearings in the raceways. This is accomplished, in part, through modifications to the shapes of the slides.

FIG. 3 illustrates an example embodiment of the present disclosure as implemented in a four-piece telescoping slide 200 in both a perspective view and a side view. As shown, the slide includes a first, fixed rail member 210, a first intermediate rail member 220, a second intermediate rail member 230, and a fourth rail member 240 that would be secured to a payload or a payload carrying structure (e.g., a drawer, a tray, etc.), not shown. Each of the aforementioned rail members includes a counterpart, where the rail members are connected to their counterparts via a front member 250, rear member 270, and brace 260. The front member 250 and brace 260 ensure the translation of the rail members is substantially equivalent for both sides of the telescoping slides to avoid binding. The front member 250 also carries fasteners 280 used to secure the telescoping slides 200 in the retracted, closed position as described further below.

Also shown in FIG. 3 are fasteners for holding bearings in place. As shown, the fixed rail member 210 includes fasteners 214, each of which corresponds to a bearing engaged between the fixed rail member 210 and the first intermediate rail member 220. The bearings of the illustrated embodiment may include roller bearings or cam follower bearings. Similarly, the second intermediate rail member 230 includes fasteners 234 that each correspond with a respective bearing engaged between the first intermediate rail member 220 and the second intermediate rail member 230. The fourth rail member 240 includes fasteners 244 corresponding to bearings engaged between the fourth rail member 240 and the second intermediate rail member 230. The engagement of bearings between rail members corresponds to the ability to translate load between rail members, such that engaged bearings are in contact and can transmit load, while disengaged bearings are not configured to transmit load between rail members.

FIG. 4 illustrates the four-piece telescoping slide 200 approaching the retracted, closed position in both a perspective view and a side view. As shown, the telescoping rail members 210-240 overlap one another as the slide is closed. The fastener 280 through the front member 250 has not yet engaged the fixed rail member 210, though the threads 282 of the fastener are visible through the separation between the front member 250 and the fixed rail member 210. Also visible is a wedge feature 252 of the front member 250, where the fixed rail member 210 includes a corresponding recess 212, both of which are shown in greater detail below in FIG. 7. The position of the four-piece telescoping slide of FIG. 4 corresponds to the top illustration of FIG. 7 in which the threads 282 of the fastener 280 are visible.

FIG. 5 illustrates the four-piece telescoping slide 200 in the pre-closed position in both a perspective view and a side view. As shown, the telescoping rail members 210-240 overlap one another as in FIG. 4. The fastener threads 282 of the fastener 280 engage a corresponding threaded hole within the recess 212 of the fixed rail member 210, and the wedge feature 252 engages the recess 212 of the fixed rail member 210. As the wedge feature 252 engages the recess 212, angled ramp elements 256 of the wedge feature engage corresponding angled ramp elements 216 of the recess 212, as more clearly illustrated in the middle image of FIG. 7 which corresponds to the pre-closed position depicted in FIG. 5.

FIG. 6 illustrates the four-piece telescoping slide 200 in the closed position in both a perspective view and a side view. The fastener 280 is engaged with the fixed rail member 210 in response to turning of the fastener and engaging the threads 282 of the fastener with a threaded hole of the fixed rail member. The bottom image of FIG. 7 illustrates this engagement and corresponds to the closed position illustrated in FIG. 6. As shown, the wedge feature 252 has fully engaged the recess 212 and the angled ramp elements 256 of the wedge feature 252 have engaged the angled ramp elements 216 of the recess 212. As illustrated between the pre-closed position of the middle image of FIG. 7 and the closed position of the bottom image of FIG. 7, the wedge feature 252 engaging the recess 212 aligns the front element 250 with the fixed rail member 210. In doing so, the front member 250 is raised up relative to the fixed rail member 210, which raises the bearings corresponding to fasteners 214 away from engagement in the slide. Raising the bearings and disengaging them from the rail on which they travel when the slide is translated from the retracted, closed position to the extended, open position removes loading from the bearings. Removing the loading from the bearings, particularly when a heavy payload is carried by the slide 200, preserves the integrity of the bearings during vibration and impacts experienced by the slide 200.

While the illustrations of FIG. 3-7 depict raising the front member 250 relative to the fixed rail member 210, bearings proximate the rear member 270 may be unloaded in a corresponding manner. FIG. 8 illustrates a portion of the rear member 270 including a wedge element 272 configured to engage a rear end of the fourth rail member 240. FIG. 9 illustrates the slides in an almost-closed position, where a rear end 241 of the fourth rail member 240 is driven to engage the wedge element 272 with corresponding recesses in the rear end 241 of the fourth rail member 240. This engagement, similar to that of the front member 250 with the recess 212 of the fixed rail element 210, raises the fourth rail member 240 and disengages the bearings with the rail member along which the bearings travel when the slide 200 is translated between the retracted position and the extended position. Thus, according to an example embodiment, when the slide 200 is fully seated in the retracted, closed position, the bearings of the slide do not support the payload weight.

While the aforementioned embodiments include a wedge element and a corresponding recess, a variety of configurations could be used to achieve the desired effects of unloading the bearings when the slides are seated in the retracted, closed position. Such configurations could include a pin and hole configuration, where a pin may be angled or tapered such that engagement of the hole into the pin causes movement of one relative to the other in a plane substantially orthogonal to a longitudinal axis of the pin. Each of these configurations serves to perform a lifting function to raise the rail member supporting the payload and disengage the bearings of the slide. As such, whether a wedge element and recess or tapered pin and hole, or two complementary angled surfaces, each relates to a lifting mechanism effected by cooperative surfaces or cooperative lifting elements. Further, while a threaded fastener 280 is illustrated and described to fully seat the slide in the retracted, closed position by engaging a threaded hole in the fixed rail member 210, this could be accomplished by a fastener in the front member 260 engaging a bracket or frame not part of the slide 200. Optionally, a door that closes over the slide when the payload and slide are in the retracted, closed position may be configured to drive the slide into a fully retracted and closed position. Further, embodiments may include a locking latch, a cam and follower mechanism, twist-lock fasteners, or the like to secure the slide in a retracted position whereby the bearings are unloaded.

FIG. 10 illustrates a simplified example of the mechanism by which the bearings are unloaded when the slides are in the retracted, closed position. A fixed rail member 310 is illustrated in a semi-transparent manner such that the bearings 318 can be viewed through the fixed member, along with a second rail member 320. As shown, the second rail member 320 is riding along bearings 318 through contact at 390 in the top illustration. When the slide is carrying a payload, that payload weight is transferred to the bearings by the second rail member 320 through that contact. The fixed rail member 310 includes wedge element 372 or at least the upper surface thereof, which may be attached to a rear member (not shown) and a recess 312 or at least a bottom surface thereof. The second rail member 320 includes a recess 322 or at least the upper surface thereof and a wedge element 352 or at least the lower surface thereof, which may be attached to a front member (not shown). The middle illustration of FIG. 10 illustrates the second rail member 320 being moved toward the retracted, closed position, where the wedge element 372 and recess 312 of the fixed rail member engage the recess 322 and the wedge element 352 of the second rail member, respectively.

The bottom illustration of FIG. 10 shows full engagement in the retracted, closed position of the second rail member 320 with the fixed rail member 310. As shown, the wedge element 372 has fully engaged the recess 322 of the second rail member 320, while the wedge element 352 of the second rail member has fully engaged the recess 312 of the fixed rail member 310. In doing so, the second rail member has been lifted up, thereby taking the second rail member 320 out of contact with the bearings 318 with gap 392. This unloads the bearings 318 such that any dynamic impact or vibration on the payload, such as during transport, would not be translated to the bearings 318 such that damage through such impact or vibration may be avoided.

While the illustrated and described embodiments depict a raising of a rail member to unload the bearings, embodiments may fix the rails relative to one another in a vertical relationship when in the retracted position to avoid movement of the rail members relative to one another up or down. Embodiments illustrated in FIG. 7 including the interfacing wedge element 252 and corresponding recess 212 provide a vertically fixed relationship between the rail members that may avoid movement and possible damage to the bearings during dynamic loading and vibration of the slide assembly. While the illustrated embodiments depict fixing the relationship between the rail members in the vertical direction, embodiments may optionally provide a fixed relationship between the rail members in a horizontal plane, orthogonal to the direction of extension of the rail members. For example, if the wedge element 252 of FIG. 7 is pyramidal, conical, frusto-pyramidal, or frustoconical in shape, with a correspondingly shaped recess, engaging the element with the recess would secure the rail members relative to one another in all three orthogonal axes.

Example embodiments illustrate the engagement between a wedge element and a corresponding recess; however, as will be appreciated by one of ordinary skill in the art, the recess and wedge element (or conical/pyramidal element) may be transposed and still provide the same functionality. Further, according to example embodiments in which the slide includes one or more intermediate members (e.g., the slide includes three or more rail members), the lifting elements may be configured to lift the intermediate elements together with the payload bearing rail member. Optionally, separate lifting elements may be included for intermediate members to separately lift and maintain separation between intermediate rail members and the payload bearing rail member, for example.

FIG. 11 depicts the example of the mechanism by which the bearings are unloaded when the slides are in the retracted, closed position as in FIG. 10. However, the example embodiment of FIG. 11 further includes raceway reliefs 400 within the bearing track or raceway that may facilitate the unloading of the bearings 318 in the retracted position shown in the bottom illustration of FIG. 11. As shown, raceway reliefs 400 are positioned along a raceway of second rail member 320. The raceways in which bearings 318 travel may be sized such that they area close fit with the bearings 318, thereby enabling smother movement between the retracted and extended positions, while also providing a more stable load bearing platform. However, with raceways sized to fit the bearings, there may be little room to unload the bearings in the retracted position. As such, the raceway reliefs 400 may be positioned within the raceway such that the bearings 318 align with the raceway reliefs 400 when the second rail member 320 is in the retracted position. This enables the bearings to rise free of the lower surface in which the raceway reliefs are present and allows the bearings to be unloaded and avoid supporting the payload. As shown in FIG. 11, as the second rail member 320 advances from the extended position to the retraced position, progressing from right to left from the top illustration to the bottom illustration, the bearings 318 come into alignment with the raceway reliefs 400. As shown in the bottom most illustration of FIG. 11, the raceway reliefs 400 are aligned with the bearings 318, and the bearings are disengaged from the raceway. These reliefs may be useful in slide arrangements where the bearing and raceways in which the bearings travel are closely sized.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A slide comprising:

a fixed rail member;

a second rail member, wherein the second rail member translates between an extended position relative to the fixed rail member and a retracted position relative to the fixed rail member;

a third rail member, wherein the second rail member is disposed between the fixed rail member and the third rail member, wherein the third rail member translates between an extended position relative to the fixed rail member and a retracted position relative to the fixed rail member; and at least one bearing attached to one of the second rail member or the third rail member, wherein the at least one bearing is engaged with both the second rail member and the third rail member when the second rail member is in the extended position, and wherein the at least one bearing is disengaged from at least one of the second rail member or the third rail member when the third rail member is in the retracted position.

2. The slide of claim 1, wherein the fixed rail member comprises a first lifting element, wherein the third rail member comprises a second lifting element, wherein in response to the third rail member being moved to the retracted position, the first lifting element cooperates with the second lifting element to raise the third rail member relative to the fixed rail member, and in response to the third rail member being raised, the third rail member raises the second rail member thereby disengaging the at least one bearing from at least one of the second rail member and the third rail member.

3. The slide of claim 2, wherein the first lifting element comprises at least one of a pin, a wedge element, a conical element, a frustoconical element, a pyramidal element, a frusto-pyramidal element, and a recess, and wherein the second lifting element comprises at least one of a pin, a wedge element, a conical element, a frustoconical element, a pyramidal element, a frusto-pyramidal element, and a recess.

4. The slide of claim 1, further comprising at least one second bearing attached to one of the fixed rail member or the second rail member, wherein the at least one second bearing is engaged with both the fixed rail member and the second rail member in response to the third rail member being in the extended position, and wherein the at least one second bearing is disengaged from at least one of the fixed rail member and the second rail member in response to the second rail member being disposed in the retracted position.

5. The slide of claim 4, wherein the third rail member comprises a third lifting element, wherein in response to the third rail member being moved to the retracted position, a first lifting element cooperates with the third lifting element to raise the third rail member relative to the fixed rail member, thereby disengaging the at least one second bearing from at least one of the second rail member and the third rail member.

6. The slide of claim 1, further comprising a fastener coupled to the third rail member, wherein the fastener secures the third rail member to the fixed rail member in response to the third rail member being in the retracted position and the fastener being engaged with the fixed rail member.

7. The slide of claim 6, wherein engagement of the fastener with the fixed rail member drives the third rail member into the retracted position.

8. The slide of claim 1, further comprising a front member attached to the second rail member and a fastener extending through the front member, wherein the fastener is configured to engage the fixed rail member and secure the third rail member to the fixed rail member in the retracted position.

9. A slide comprising:

a fixed rail member comprising a first lifting element;

a second rail member comprising a second lifting element, wherein the second rail member translates between an extended position relative to the fixed rail member and a retracted position relative to the fixed rail member; and an intermediate rail member disposed between the fixed rail member and the second rail member, wherein the intermediate rail member translates between an extended position relative to the fixed rail member and a retracted position relative to the fixed rail member;

wherein in response to the second rail member translating to the retracted position, the first lifting element cooperates with the second lifting element to raise the intermediate rail member relative to the fixed rail member.

10. The slide of claim 9, wherein the second rail member supports a payload, the slide further comprising at least one bearing disposed between the intermediate rail member and the second rail member, wherein in response to the second rail member being in the extended position relative to the fixed rail member, the at least one bearing bears at least a portion of a weight of the payload.

11. The slide of claim 10, wherein in response to the second rail member being in the retracted position, the at least one bearing does not bear at least a portion of the weight of the payload.

12. The slide of claim 9, wherein the second rail member supports a payload, the slide further comprising at least one first bearing disposed between the fixed rail member and the intermediate rail member, and at least one second bearing disposed between the intermediate rail member and the second rail member, wherein in response to the intermediate rail member being in the extended position relative to the fixed rail member, the at least one first bearing bears at least a portion of a weight of the payload, and in response to the second rail member being in the extended position relative to the fixed rail member, the at least one second bearing bears at least a portion of the weight of the payload.

13. The slide of claim 12, wherein in response to the intermediate rail member being in the retracted position and the second rail member being in the retracted position, the at least one first bearing does not bear at least a portion of the weight of the payload and the at least one second bearing does not bear at least a portion of the weight of the payload.

14. The slide of claim 9, further comprising a fastener coupled to the second rail member, wherein the fastener secures the second rail member to the first rail member in response to the second rail member being in the retracted position and the fastener being engaged with the fixed rail member.

15. The slide of claim 14, wherein engagement of the fastener with the fixed rail member drives the second rail member into the retracted position.

16. The slide of claim 9, further comprising a front member attached to the second rail member and a fastener extending through the front member, wherein the fastener is configured to engage the fixed rail member and secure the second rail member to the fixed rail member in the retracted position.

17. A method comprising:

supporting a payload on a second rail member in response to the second rail member being in an extended position relative to a fixed rail member and an intermediate rail member between the fixed rail member and the second rail member, wherein the payload weight is transferred from the second rail member through the intermediate rail member to the fixed rail member through at least one bearing; and lifting the intermediate rail member relative to the fixed rail member in response to the second rail member being moved to a retracted position, wherein the payload weight ceases to be transferred from the second rail member to the intermediate rail member and the fixed rail member through the at least one bearing.

18. The method of claim 17, wherein the lifting of the intermediate rail member relative to the fixed rail member is performed in response to a first lifting element of the fixed rail member engaging a second lifting element of the second rail member in response to the second rail member being secured in the retracted position.

19. The method of claim 18, wherein the first lifting element comprises at least one of a pin, a wedge element, a conical element, a frustoconical element, a pyramidal element, a frusto-pyramidal element, and a recess, and wherein the second lifting element comprises at least one of a pin, a wedge element, a conical element, a frustoconical element, a pyramidal element, a frusto-pyramidal element, and a recess.

20. The method of claim 17, wherein lifting the intermediate rail member relative to the fixed rail in response to the second rail member being moved to the retracted position further comprises driving the second rail member to the retracted position with a fastener engaging the second rail member with the fixed rail member.

* * * * *